United States Patent [19]

Bertolotti et al.

[11] 4,308,881

[45] Jan. 5, 1982

[54] APPARATUS FOR COOLING ELONGATED PRODUCTS DURING THEIR PASSAGE THROUGH THE APPARATUS

[75] Inventors: Francis Bertolotti, Colombelles; Jean-Claude Daverio; Georges Weber, both of Metz, all of France

[73] Assignee: Institut de Recherches de la Siderurgie Francaise, Saint-Germain-en-Laye, France

[21] Appl. No.: 115,554

[22] Filed: Jan. 21, 1980

[30] Foreign Application Priority Data

Jan. 19, 1979 [FR] France ..... 79 01567

[51] Int. Cl.[3] ..... B08B 3/04

[52] U.S. Cl. ..... 134/122 R; 134/199; 72/201; 266/111; 266/114

[58] Field of Search ..... 72/201; 134/9, 15, 64 R, 134/122 R, 199; 266/111-114

[56] References Cited

U.S. PATENT DOCUMENTS

| | | | |
|---|---|---|---|
| 1,672,061 | 6/1928 | George | 134/122 R |
| 2,509,668 | 5/1950 | Berggren | 134/64 R |
| 3,945,623 | 3/1976 | Gaudilliere et al. | 266/112 |
| 4,064,884 | 12/1977 | Asp | 134/64 R X |

FOREIGN PATENT DOCUMENTS

| | | | |
|---|---|---|---|
| 351712 | 4/1922 | Fed. Rep. of Germany | 226/114 |
| 2556383 | 10/1976 | Fed. Rep. of Germany | 134/64 R |

*Primary Examiner*—Robert L. Bleutge
*Attorney, Agent, or Firm*—Michael J. Striker

[57] ABSTRACT

An apparatus for cooling an elongated product during its movement through the apparatus comprises an elongated tube having a cooling fluid inlet at one end and a cooling fluid outlet at the other end so that the cooling fluid will flow from the one to the other end through the tube. The product to be cooled passes through the tube either in the same or in a direction opposite to the direction of flow of cooling fluid through the tube. At least one centralizing element is provided in the tube spaced from the opposite ends of the latter and having a central passage coaxial with the tube and a diameter smaller than that of the tube for the passage of the product therethrough, and a plurality of channels uniformly distributed about the central passage to facilitate flow of cooling water from one to the other end of the tube. In this way a uniform cooling of the product is obtained even if the product is relatively long and heavy, such as steel bars, which due to their weight and their slow movement through the apparatus are liable to bend and come in contact with the tube in the absence of such centralizing elements.

9 Claims, 4 Drawing Figures

APPARATUS FOR COOLING ELONGATED PRODUCTS DURING THEIR PASSAGE THROUGH THE APPARATUS

BACKGROUND OF THE INVENTION

The present invention relates to an apparatus for cooling elongated products during their passage through the apparatus.

Apparatus of this type essentially comprises an elongated tube flown through by a cooling liquid, usually water, and through which passes also the elongated product to be cooled.

The tube is equipped at one of its ends with a cooling fluid supplying head and at its opposite end with a separator used to separate at the outlet end of the tube the product passing therethrough from the cooling fluid.

Such apparatus is especially used in the field of metallurgy and more precisely for special thermic treatment of elongated products coming from a hot rolling mill. However, such apparatus may evidently be used also for other applications.

Despite the efficiency of such known apparatus the homogeneity of the treatment of the product is nevertheless not always obtained due to the form of the product to be cooled and the speed with which it is passed through the apparatus.

It has been especially ascertained that the uniformity of the thermic treatment is essentially better in the case of cooling elongated round bars provided with a helical groove than round bars having a smooth cylindrical outer surface. Questioning the cause of this difference, the inventors have visualized the possibility that this difference results from contact of the product passing through the tube with the interior surface of the latter.

It will be understood that under these conditions the cooling liquid cannot any longer uniformly cool the product over its whole circumference.

Experiments carried out by the inventors have confirmed this initial hypothesis and experience has effectively shown that elongated products such as steel bars present due to their weight and the relatively low speed at which they pass through the apparatus in the interior of the tube a sag or bent large enough so that the product will partially abut against the bottom surface of the tube. The reason why bars provided at the outer surface with a helical groove are better treated than bars having a smooth cylindrical outer surface seems therefore clear since the grooves permit the passage of the cooling liquid beneath the portion of the bar which abuts against the inner surface of the tube.

In order to prevent contact of any portion of the bar with the inner surface of the tube a cooling apparatus has already been proposed in which a plurality of guide funnels are provided in the tube (French Pat. No. 1,569,259), but this apparatus does not assure a uniform cooling of the product and it is necessary to provide a plurality of cooling fluid injection means over the length of the apparatus. Apparatus had likewise already been proposed with guidance elements of more complex form which permit to create a turbulence of the cooling fluid (German Pat. No. 2,556,383) or provided with elliptic sections which are rotatable about the axis of the tube (U.S. Pat. No. 4,126,544).

All these known apparatus can be used only with a great supply of the cooling fluid assuring a high speed of the cooling fluid through the apparatus due to great pressure loss resulting from the guide elements.

SUMMARY OF THE INVENTION

It is an object of the present invention to provide an apparatus for cooling elongated products during their passage through the apparatus and which avoids the disadvantages of such apparatus known in the art.

It is a further object of the present invention to provide an apparatus for cooling elongated products during their passage through the apparatus in which the products are uniformly cooled while passing through the apparatus.

It is a further object of the present invention to provide an apparatus of the aforementioned kind which is composed of relatively simple parts so that the apparatus may be built at reasonable cost and will stand up perfectly under extended use.

With these and other objects in view, which will become apparent as the description proceeds, the apparatus of the present invention for cooling an elongated product during its movement through the apparatus mainly comprises an elongated tube having a cooling fluid inlet at one end and a cooling fluid outlet at the other end so that the cooling fluid will flow from the one to the other end through the tube. The apparatus comprises further at least one centralizing element spaced from the opposite ends of the tube and having a central passage therethrough coaxial with the axis of the tube and having a diameter smaller than that of the tube for the passage of the product therethrough and a plurality of channels uniformly distributed about the central passage to facilitate flow of cooling fluid from one to the other end of the tube.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
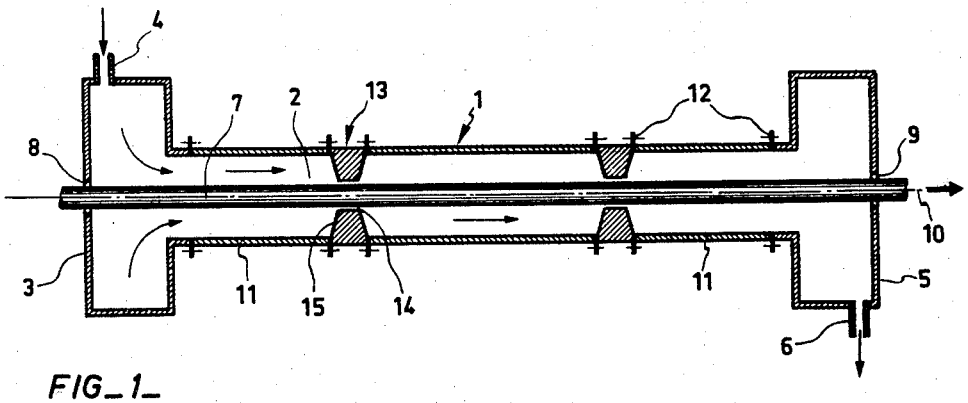
FIG. 1 is a schematic longitudinal section through the apparatus of the present invention.

Referring now to the drawing, and more specifically to FIG. 1 of the same, it will be seen that the cooling apparatus according to the present invention comprises an elongated tube 1 flown through in the direction as indicated by the arrows by a cooling fluid 2, usually water. The tube 1 is provided at one of the ends thereof with a cooling fluid supply head 3 into which the cooling fluid is introduced by a tubular cooling fluid inlet 4. A separator 5 is provided at the opposite end of the tube 1 provided with a cooling fluid outlet 6. The elongated product 7 to be cooled passes in longitudinal direction through the apparatus and for this purpose openings 8 and 9 coaxially with the axis 10 of the tube are respectively provided in the cooling fluid supply head 3 and the separator 5 which permit free passage of the product 7 through the apparatus.

It is mentioned that the product 7 to be cooled may be passed through the apparatus in the same direction as the cooling fluid passes therethrough, or in direction opposite to the direction of the stream of cooling fluid. The arrow at the right end of the product 7 shown in FIG. 1 should only indicate that the product is not stationary but moves relative to the apparatus, but this arrow should not indicate the direction of movement of the product 7 through the apparatus.

It is further mentioned that for simplification reason, the length of the tube 1 is shown in FIG. 1 considerably reduced as compared to the inner diameter of the tube. As an example, it is mentioned that the length of the tube of the cooling apparatus is a plurality of meters, generally in the order of 4 to 6 meters, while the inner diameter of the tube, though depending on the range of the cross-sections of the products to be cooled, very rarely exceed about 10 centimeters. Preferably the tube 1 is usually composed of a plurality of tube sections 11 which may each have a length of about 2 meters, and which are connected to each other by connecting flanges 12.

According to the invention the tube 1 is provided with at least one, but preferably a plurality of centralizing means 13 which are axially spaced from each other. Each of the centralizing means is constituted by a tubular element coaxial with the tube 1 and advantageously interposed between two consecutive tube sections 11 and they define a central passage 14 of a diameter inferior to that of the tube 1. In order to guide the leading end of the product 7 to be cooled during its passage through the apparatus properly through the central passage of the centralizing means 13, the central passage comprises a frustoconical inlet portion 15 formed by an appropriate machining of the inner profile of the centralizing means.

Figure 2:
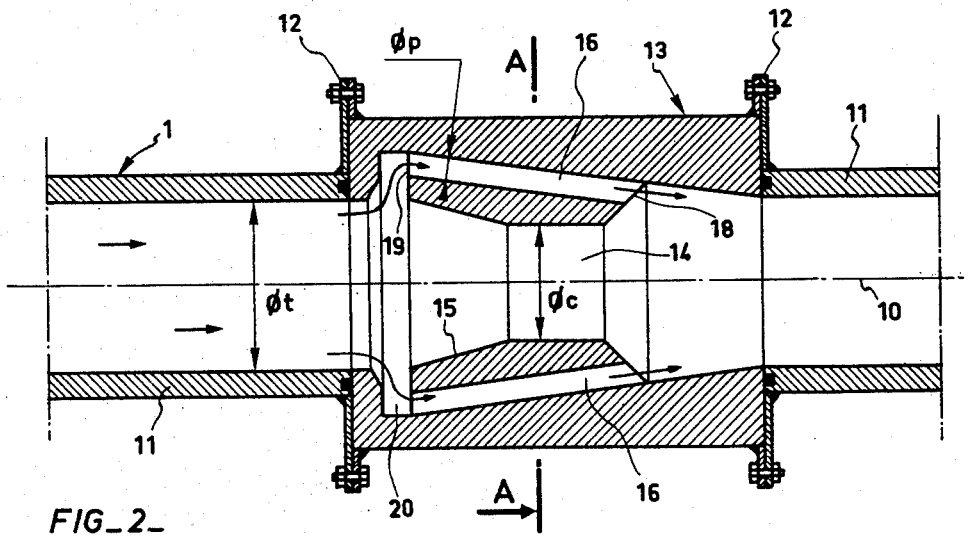
FIG. 2 is a longitudinal cross-section drawn at an enlarged scale through a detail of the apparatus shown in FIG. 1 and showing especially the centralizing means of the apparatus.
Figure 4:
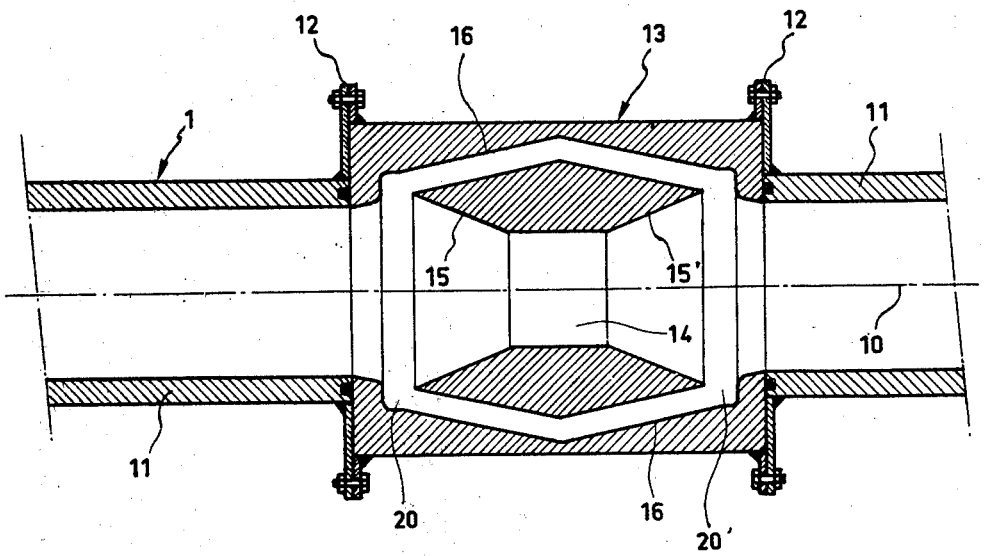
FIG. 4 is a cross-section similar to that shown in FIG. 2, but showing a modification of the centralizing means.

FIGS. 2 and 4 show two modifications of the centralizing means according to the present invention.

As shown in FIG. 2 the centralizing means 13 is interposed between two sections 11 of the tube 1 and its central passage 14 therethrough has a diameter $\phi c$ inferior to the diameter $\phi t$ of the tube 1 and has a frustoconical inlet portion 15 which converges in the direction of movement of the product to be cooled, not shown in FIG. 2. According to an essential feature of the present invention a plurality of channels 16 are further provided through the centralizing means 13 and these channels are uniformly distributed about the central passage 14.

Figure 3:
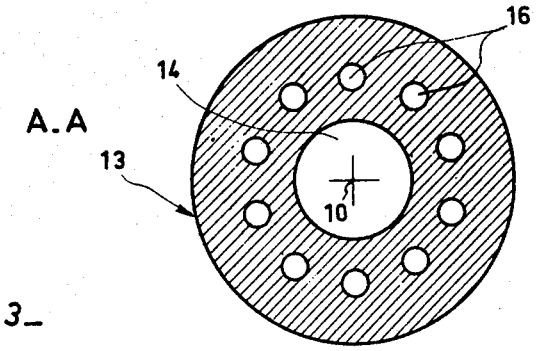
FIG. 3 is a cross-section taken along the line A—A of FIG. 2.

The channels 16, the distribution of which about the central passage 14 is best shown in the traverse cross-section of FIG. 3, are provided to facilitate flow of cooling water through the apparatus. In their absence the cooling water introduced through the inlet 4 would have to flow through the central passage 14, which already is substantially occupied by the product passing therethrough. It will be understood that under such conditions the proper function of the cooling apparatus would be disturbed by creating in the flow of cooling water considerable pressure losses which would be the greater as the diameter $\phi c$ of the central passage 14 approaches the diameter of the product passing therethrough that is, the better the central guiding of the product 7 through the apparatus will be.

The present invention reconciles therefore the two antagonistic requirements, that is on the one hand, to centralize the product 7 during its passage through the tube which assures the uniformity of its cooling, and on the other hand, the passage of the cooling water in substantially unobstructed condition through the tube to assure the efficiency of the cooling.

According to a preferred construction, which minimizes the pressure losses of the water flowing through the tube, the sum of the cross-sections of the central passage 14 and that of the peripheral channels 16 is substantially equal to the inner cross-section of the tube 1.

In one form of realization of the cooling apparatus of the present invention, $\phi t$ is equal 63 millimeters, $\phi c$ is equal 45 millimeters, and the diameter of each peripheral channel 16 $\phi p$ is equal 14 millimeters, whereby, as shown in FIG. 3, ten of such channels 16 are provided about the central passage 14.

As further shown in FIG. 2 the channels 16 are according to a further feature of the present invention not parallel to the axis 10 of the tube 1, but slightly inclined with respect thereto towards the axis in the direction of the flow of water through the apparatus.

The plurality of peripheral channels 16 will thus cause a circulation of the cooling water converging toward the product 7 passing through the apparatus, which permits to re-establish in a perfect manner downstream of the centralizing means 13 a layer of liquid which envelops the product 7 to be cooled.

According to an advantageous variation, the channels 16 are formed in such a manner that the outlet ends 18 thereof are circumferentially displaced about the axis 10 with respect to the corresponding inlet ends 19. It will be understood that this construction will produce at the outlet end of the channels 16 a uniform gyratory motion of the cooling water about the product 7 to be cooled.

Under these conditions the centralizing means 13 produces a supplementary function of a deflector acting on the liquid envelope surrounding the product to be cooled, by transforming a rectilinear flow of this envelope upstream of the centralizing means 13 to a helicoidal circulation downstream of the centralizing means. This variation permits therefore, while maintaining the relative speed of the cooling water with respect to the product to be cooled, to increase the stay of the cooling water in the tube, or at a predetermined stay of the cooling water, to reduce the length of the tube.

A further advantage of this modification is that due to the centrifugation, the separation of the cooling water from the product at the outlet end of the tube is essentially facilitated.

The channels 16 may be rectilinear or, as preferred, curved, which permits an even more important displacement of the outlet ends 18 of the channels 16 without producing abrupt change of direction of the circulating cooling water.

It will be evident that the modification illustrated in FIG. 2 is preferably used in an apparatus in which the product 7 passes in the direction of the flow of cooling water through the apparatus.

FIG. 4 illustrates another modification according to the present invention in which the centralizing means 13' are of the universal type, that is, they may be used in apparatus in which the product to be cooled passes through the apparatus in co-current direction or in counter-current direction with respect to the flow of cooling water therethrough. For this purpose the central passage 14 through the centralizing means 13' shown in FIG. 4 has on opposite sides of the cylindrical portion frustoconical portions 15 respectively 15' which will assure proper guidance of the product to be cooled through the central passage regardless of the direction at which the product 7 to be cooled is passed through the apparatus. In addition, the peripheral channels 16' have each the form of an open V, which permits the cooling water to converge onto the product to be cooled at the outlet end of the centralizing means 13, regardless of the direction of circulation of the cooling water.

The centralizing means according to the present invention are constructed in such a manner to assure that the leading end of the product 7 during its passage through the apparatus will not abut against a portion of the centralizing means.

For this purpose the inlet cone 15 upstream of the central passage 14 is preferably constructed in such a manner that its large diameter end is at least equal but preferably greater than the inner diameter of the tube 1. This leads generally to provide for practical reasons an annular throat 20 (20') at the entrance end of the centralizing means as clearly shown in FIGS. 2 and 4.

While the apparatus of the present invention may be used for cooling any long product passing therethrough, the present invention is especially useable for cooling of products of large size, such as steel bars, which, due to their weight and the slow speed (2–4 meters per second) at which they are moved through the apparatus are most liable to come in contact with the inner surface of the tube 1.

It will be understood that each of the elements described above, or two or more together, may also find a useful application in other types of apparatuses for cooling long products during their passage through the apparatus differing from the types described above.

While the invention has been illustrated and described as embodied in an apparatus for cooling long products, especially steel bars, during their passage through the apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for cooling an elongated product during its passage through the apparatus and comprising an elongated tube having a cooling fluid inlet at one end and a cooling fluid outlet at the other end so that the cooling fluid may pass in longitudinal direction through the tube; means connected to said tube for centralizing the product to be cooled with respect to said tube, said centralizing means comprising at least one annular centralizing element axially displaced from opposite ends of said tube and provided with a central passage therethrough coaxial with said tube and having a diameter smaller than the inner diameter of the tube for the passage of the product to be cooled and a plurality of channels arranged radially outwardly of said central passage and distributed about the latter for the passage of cooling fluid therethrough.

2. Apparatus as defined in claim 1, wherein the sum of the cross-sections of said central passage and that of said channels is substantially equal to the inner cross-section of said tube.

3. Apparatus as defined in claim 1, wherein each of said channels has a fluid inlet end and a fluid outlet end and is inclined with respect to the axis of the tube in such a manner that the inlet end is spaced further from said axis than said outlet end.

4. Apparatus as defined in claim 3, wherein said outlet end of each channel is circumferentially displaced from the inlet end thereof.

5. Apparatus as defined in claim 4, wherein each of said channels is curved in longitudinal direction.

6. Apparatus as defined in claim 1, wherein each of said channels presents in longitudinal cross-section a profile in form of a V.

7. Apparatus as defined in claim 6, wherein said central passage has a substantially cylindrical central portion and two frustoconical portions to opposite sides of the central portion and respectively tapering towards the latter.

8. Apparatus as defined in claim 1, wherein said central passage has a frustoconical inlet portion tapering in the direction of movement of the products therethrough.

9. Apparatus as defined in claim 1, wherein said tube comprises a plurality of tube sections and wherein a centralizing means is arranged between two successive tube sections and constructed to connect the successive tube sections to each other.

* * * * *